US008269809B2

(12) United States Patent
Nihashi et al.

(10) Patent No.: US 8,269,809 B2
(45) Date of Patent: Sep. 18, 2012

(54) PRINTING APPARATUS

(75) Inventors: Kiyotake Nihashi, Shizuoka (JP); Tetsuya Seki, Shizuoka (JP); Yoshimasa Inoue, Shizuoka (JP); Norihisa Shiraishi, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 388 days.

(21) Appl. No.: 12/712,233

(22) Filed: Feb. 25, 2010

(65) Prior Publication Data

US 2010/0231681 A1 Sep. 16, 2010

(30) Foreign Application Priority Data

Mar. 16, 2009 (JP) ..... 2009-063403
Mar. 16, 2009 (JP) ..... 2009-063404

(51) Int. Cl.
*B41J 11/00* (2006.01)

(52) U.S. Cl. ..... 347/218

(58) Field of Classification Search ..... 347/171, 347/218; 400/120.01
See application file for complete search history.

(56) References Cited

U.S. PATENT DOCUMENTS

| | | | | |
|---|---|---|---|---|
| 7,262,786 | B2 * | 8/2007 | Kang et al. | 347/171 |
| 8,004,547 | B2 * | 8/2011 | Saga | 347/171 |

FOREIGN PATENT DOCUMENTS

| | | |
|---|---|---|
| JP | 2-15366 | 1/1990 |
| JP | 10-157243 | 6/1998 |
| JP | 2003-176065 | 6/2003 |
| JP | 2007-190904 | 8/2007 |

* cited by examiner

*Primary Examiner* — Kristal Feggins
(74) *Attorney, Agent, or Firm* — Turocy & Watson, LLP

(57) ABSTRACT

In a printing apparatus, a dot head moves along a movement path which is orthogonal to a conveyance direction of a passbook, one end side of the head movement path is a speed-up area, a halfway part is a constant speed printing area, and the other end side is a slow-down area. A thermal head is disposed in a direction orthogonal to a conveyance direction of a thermal sheet, and a width size in the orthogonal direction is not smaller than the printing area of the dot head.

10 Claims, 16 Drawing Sheets

PRINTING APPARATUS

CROSS-REFERENCE TO RELATED APPLICATION

This application is based upon and claims the benefit of priority from the prior Japanese Patent Application No. 2009-063403, filed Mar. 16, 2009; and No. 2009-063404, filed the entire contents both of which are incorporated herein by reference.

TECHNICAL FIELD

The present invention relates to a printing apparatus to selectively convey a passbook or a thermal sheet as a print medium and to print.

BACKGROUND

In this type of printing apparatus, a sheet entrance and exit port for entrance and exit of a statement sheet and a passbook entrance and exit port for entrance and exit of a passbook are disposed up and down on the front side. The statement sheet inserted from the sheet entrance and exit port is conveyed to a print section along a sheet conveyance path, and the passbook inserted from the passbook entrance and exit port is conveyed to the print section along a passbook conveyance path.

The statement sheet or the passbook conveyed to the print section is printed by a dot head (serial head). The printed statement sheet or passbook is reversely sent and is sent out from the sheet entrance and exit port or the passbook entrance and exit port (see, for example, JP-A-2003-176065).

In the print section, a head movement path is provided along a direction orthogonal to the conveyance direction of the statement sheet or the passbook, and the dot head is moved along the head movement path. That is, the dot head is moved from one end side of the head movement path and reaches the other end side after printing is performed.

The one end side of the head movement path is an area where the dot head speeds up the movement speed, a halfway part is a constant speed area where it moves at constant speed, and the other end side is an area where the movement speed is slowed down.

When the dot head prints in the speed-up area or the slow-down area, a printed character is expanded or contracted, and accordingly, printing is performed in the constant speed area.

As stated above, since the dot head prints in the constant speed area, there is a problem that a statement sheet wider than the constant speed area (printing area) can not be printed.

Incidentally, when the constant speed area (printing area) of the dot head is made close to the whole width of the apparatus body, the wide statement sheet can be printed.

However, in this case, there arises a problem that the apparatus body must be enlarged by the speed-up area and the slow-down area at both sides of the printing area.

On the other hand, hitherto, since both the statement sheet and the passbook are printed by the dot head having a low resolution, there is a problem that the print of the statement sheet is soiled.

Then, it is conceivable that a sheet conveyance path is connected to the upstream side of the passbook conveyance path to form one line conveyance system, a thermal head having a high resolution is provided in the sheet conveyance path and the dot head is provided in the passbook conveyance path.

That is, the statement sheet is printed by the thermal head, and then is discharged from the sheet conveyance path through the passbook conveyance path.

However, in this method, since the dot head is positioned at the downstream side of the statement sheet in the conveyance direction, when the passbook is printed by the dot head, the discharge of the statement sheet is delayed until the printing of the passbook is completed, and there is a disadvantage that the processing efficiency is poor.

SUMMARY

An aspect of the present invention is made in view of the above circumstances and an object thereof is to provide a printing apparatus in which printing on a print medium wider than a printing area of a serial head is enabled without enlarging an apparatus body, and a statement sheet printed by a line head can be discharged without waiting for completion of printing of a passbook.

According to an aspect of the invention, a printing apparatus includes a conveyance device to convey a print medium along a conveyance path, a serial head that is provided in the conveyance path and moves along a head movement path which is orthogonal to a conveyance direction of the print medium and in which one end side is a speed-up area, a halfway part is a constant speed printing area, and the other end side is a slow-down area, and a line head that is disposed in the conveyance path along a direction orthogonal to the conveyance direction of the print medium, and has a print width size in the orthogonal direction not smaller than the printing area of the serial head.

According to another aspect of the invention, a printing apparatus includes a discharge port to discharge a passbook or a statement sheet, a first conveyance device to convey a roll sheet along a first conveyance path, a line head to print on the roll sheet conveyed by the first conveyance device, a cutting device to cut the roll sheet printed by the line head into a specified size and to form a statement sheet, a second conveyance device to convey the passbook along a second conveyance path connected to the discharge port, and a serial head to print on the passbook conveyed by the second conveyance device, a discharge side of the first conveyance path is joined to a halfway part of the second conveyance path, the joined part is closer to the discharge port than the serial head, and a distance between the cutting device and the joined part is shorter than a distance between the serial head and the joined part.

According to another aspect of the invention, a printing apparatus includes a discharge port to discharge a passbook or a statement sheet, a first conveyance device to convey a roll sheet along a first conveyance path at a first conveyance speed, a line head to print on the roll sheet conveyed by the first conveyance device, a cutting device to cut the roller sheet printed by the line head into a specified size and to form a statement sheet, a second conveyance device to convey the passbook along a second conveyance path connected to the discharge port at a second conveyance speed different from the first conveyance speed, and a serial head to print on the passbook conveyed by the second device, and the first conveyance speed is higher than the second conveyance speed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

Hereinafter, embodiments of the present invention will be described in detail with reference to the drawings.

First Embodiment

Figure 1:
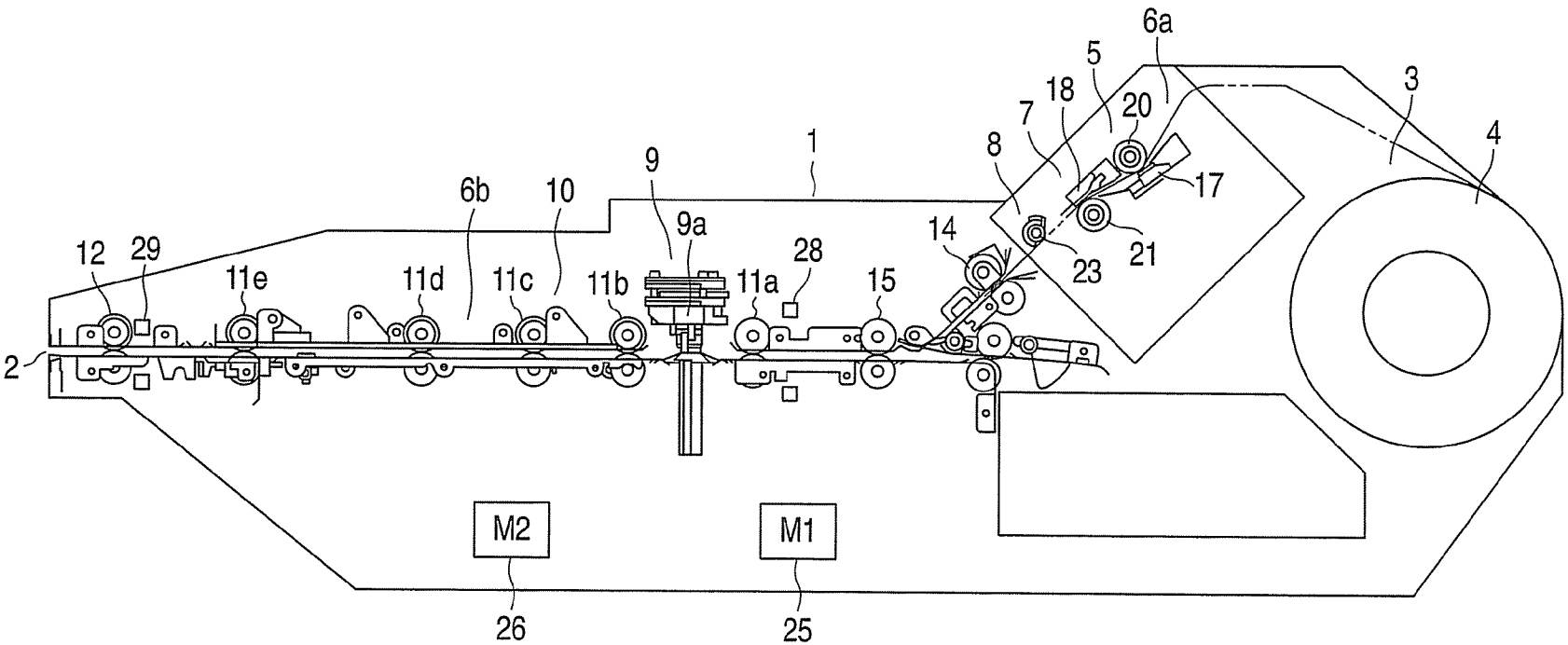
FIG. 1 is a structural view schematically showing a printing apparatus of an embodiment of the invention.

FIG. 1 is a structural view showing a printing apparatus of a first embodiment of the invention. In the drawing, reference numeral 1 denotes an apparatus body, and a facia section 2 used as both an entrance and exit of a passbook (print medium) and an exit of a statement sheet (print medium) is provided on the front side of the apparatus body 1.

A sheet loading section 3 is provided on the rear side in the apparatus body 1, and a roll-like thermal sheet 4 is loaded in the sheet loading section 3. The leading edge of the thermal sheet 4 is pulled out from the sheet loading section 3, and is conveyed by a thermal conveyance device 5 along a conveyance path 6*a*. A thermal print section 7 and a cutting section 8 are sequentially disposed in the conveyance path 6*a* along the conveyance direction of the thermal sheet 4.

Besides, a passbook conveyance device 10 to convey a passbook along a conveyance path 6*b* is provided in the apparatus body 1. One end side of the conveyance path 6*b* is connected to the facia section 2, and the other end side is connected to the discharge side of the conveyance path 6*a* of the thermal sheet 4. The passbook conveyance device 10 includes plural conveyance roller pairs 11*a* to 11*e* disposed at specified intervals in the conveyance path 6*b*, an entrance and exit roller pair 12, and a feed roller pair 15.

Besides, a passbook insertion detection sensor 29 to detect insertion of the passbook is provided at the one end side of the conveyance path 6*b*, and a detection sensor 28 to detect the leading edge of the introduced thermal sheet 4 is provided at the other end side. Further, a dot print section 9 including a dot head 9*a* as a serial head is disposed at a halfway part of the conveyance path 6*b*.

The thermal print section 7 includes first and second thermal heads 17 and 18 as line heads disposed at specified intervals along the conveyance direction of the thermal sheet 4. First and second platen rollers 20 and 21 constituting the thermal conveyance device 5 rotatably contact with the first and the second thermal heads 17 and 18. The thermal sheet 4 is nipped and conveyed by the first and the second thermal heads 17 and 18 and the first and the second platen rollers 20 and 21, and information is printed on the front and back thereof by the first and the second thermal heads 17 and 18.

The cutting section 8 includes a rotary cutter 23, and the thermal sheet 4 is cut by rotation of the rotary cutter 23 and a statement sheet is formed.

The first and the second platen rollers 20 and 21 constituting the thermal conveyance device 5, the rotary cutter 23 and a thermal side feed roller pair 14 are rotated by a first drive motor 25. The conveyance roller pairs 11*a* to 11*e* constituting the passbook conveyance device 10, the entrance and exit roller pair 12 and the feed roller pair 15 are rotated by a second drive motor 26.

Figure 2:
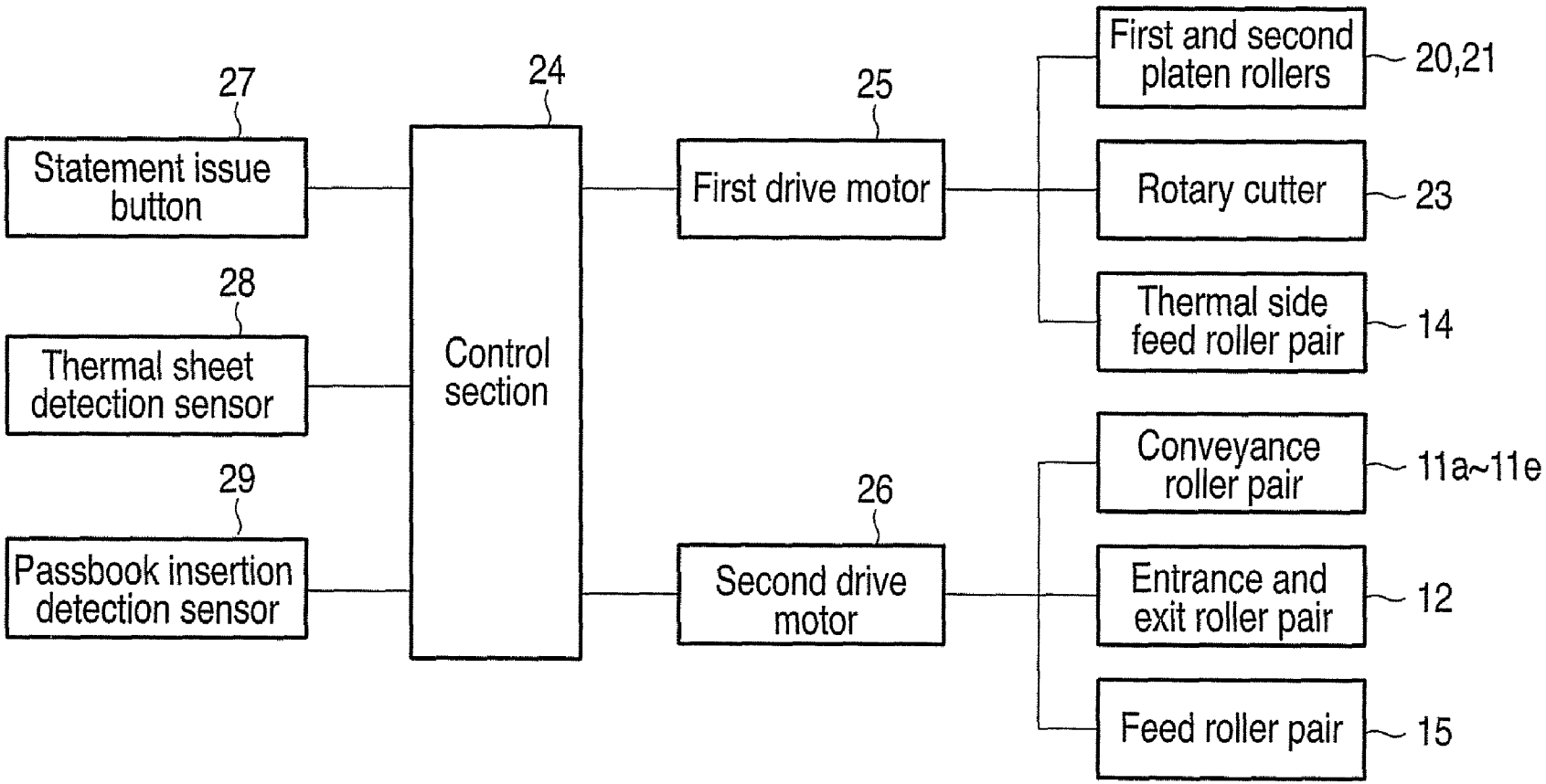
FIG. 2 is a block diagram showing a drive control system of the printing apparatus of FIG. 1.

FIG. 2 is a block diagram showing a drive control system of the printing apparatus as described above.

The thermal sheet detection sensor 28, the passbook insertion detection sensor 29 and a statement issue button 27 are connected to a control section 24 through a transmission circuit. The first and the second drive motors 25 and 26 are connected to the control section 24 through a control circuit.

The control section 24 actuates the second drive motor 26 based on the detection of the insertion of the passbook by the passbook insertion detection sensor 29, and rotates the conveyance roller pairs 11*a* to 11*e*, the entrance and exit roller pair 12, and the feed roller pair 15 in the direction (first direction) of taking in the passbook. After dot printing is completed, the control section rotates the roller pairs in the reverse direction (second direction).

Besides, the control section 24 actuates the first drive motor 25 based on the turning on of the statement issue button 27, and rotates the first and the second platen rollers 20 and 21 and the thermal side feed roller pair, 14 in the direction of sending out the thermal sheet 4.

Further, the control section 24 rotates the rotary cutter 23 based on the detection of the leading edge of the thermal sheet 4 by the thermal sheet detection sensor 28, and actuates the second drive motor 26 to rotate the conveyance roller pairs 11*a* to 11*e*, the entrance and exit roller pair 12 and the feed roller pair 15 in the second direction.

Figure 3:
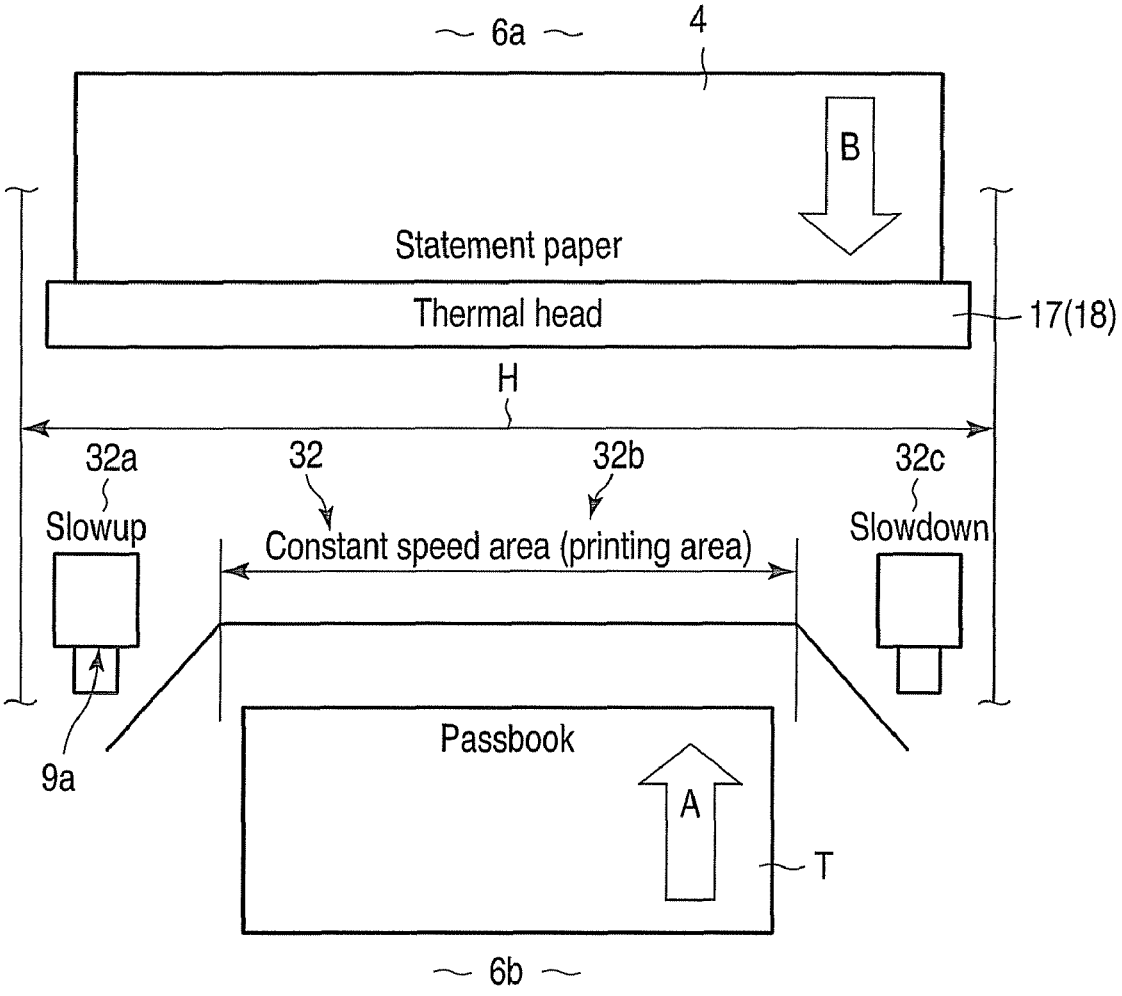
FIG. 3 is a view showing an arrangement structure of a dot head and a thermal head of FIG. 1.

As shown in FIG. 3, although the dot head 9*a* and the thermal heads 17 and 18 are disposed along the conveyance direction of the passbook T and the thermal sheet 4, the dot head 9*a* moves from one end side of a head movement path 32 orthogonal to the conveyance direction of the passbook T to the other end side. One end side of the head movement path 32 is a speed-up area 32*a* where the movement speed of the dot head 9*a* is speeded up, a halfway part is a constant speed area (printing area) 32*b* where the movement speed is constant, and the other end side is a slow-down area 32*c* where the movement speed is slowed down.

The dot head 9*a* prints on the passbook T in the constant speed area 32*b*. That is, when the dot head 9*a* prints in the speed-up area 32*a* and the slow-down area 32*c*, the printed character is expanded or contracted and becomes defective. Thus, printing is performed in the constant speed area (printing area) 32*b*.

Besides, each of the thermal heads 17 and 18 is disposed along the direction orthogonal to the conveyance direction of the thermal sheet 4, and its print width size in the longitudinal direction is not smaller than the width size of the printing area 32*b* of the dot head 9*a*, and is close to the whole width size H of the apparatus body 1.

Accordingly, even if the width size of the thermal sheet 4 is not smaller than the width size of the printing area 32*b* of the dot head 9*a*, the thermal sheet can be printed by the thermal heads 17 and 18.

Next, the print operation of the printing apparatus constructed as described above will be described.

First, a case where printing is performed on the passbook T will be described.

Figure 4:
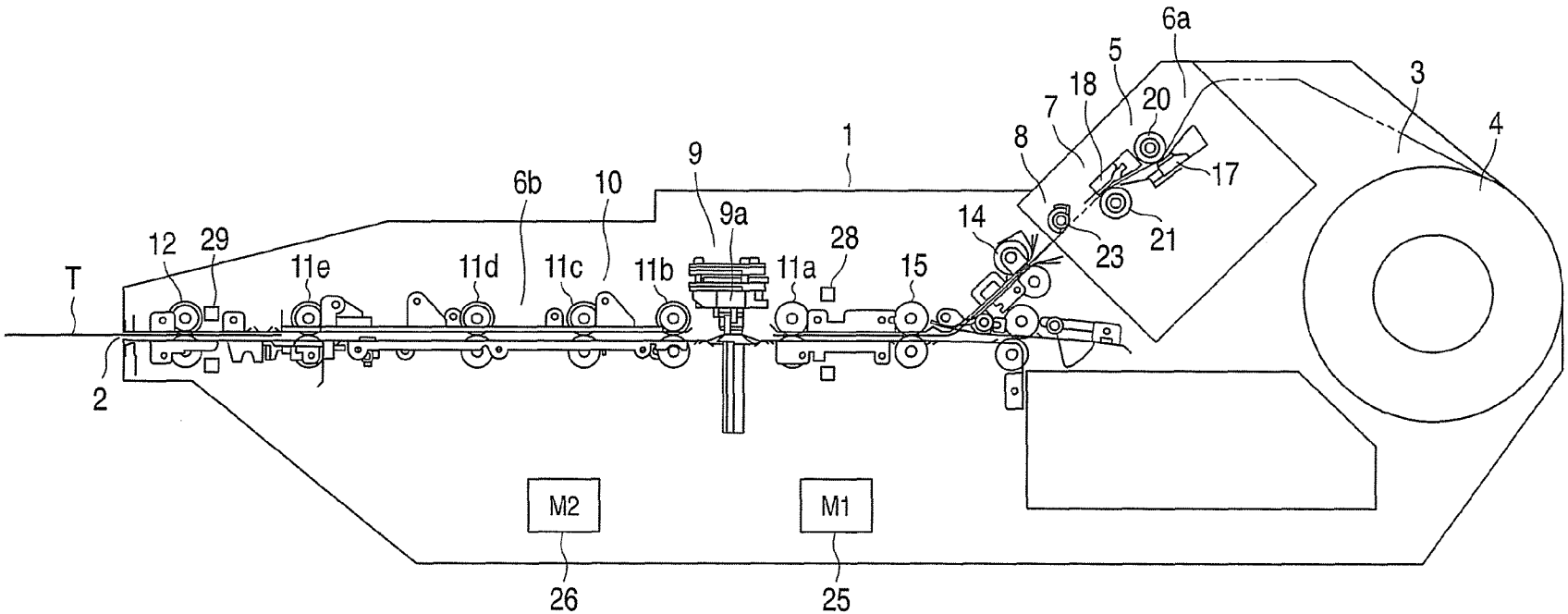
FIG. 4 is a view showing a state where a passbook is inserted in the printing apparatus of FIG. 1.
Figure 5:
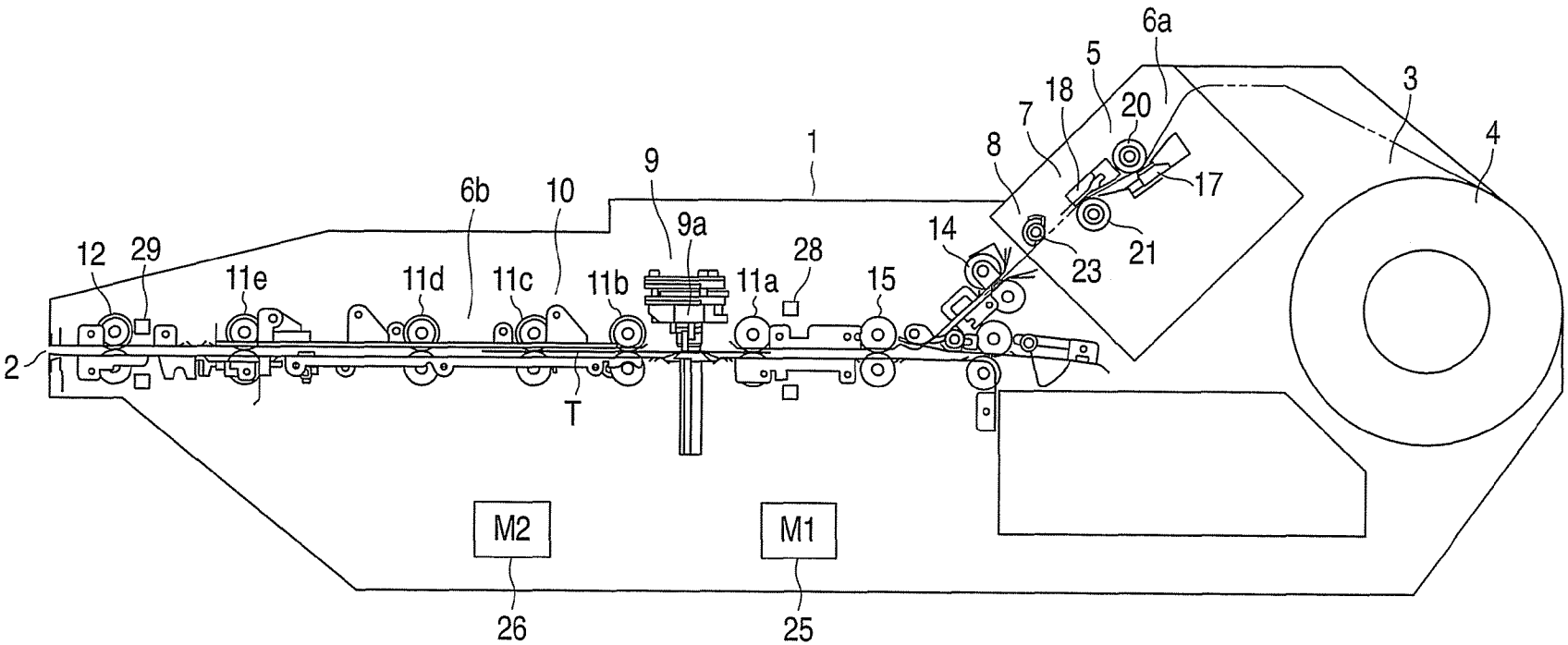
FIG. 5 is a view showing a state where the passbook of FIG. 4 is conveyed to a dot print section and is printed.

As shown in FIG. 4, when the passbook T is inserted from the facia section 2 and is detected by the passbook insertion detection sensor 29, the second drive motor 26 is operated to rotate the entrance and exit roller pair 12, the conveyance roller pairs 11*a* to 11*e*, and the feed roller pair 15 in the first direction. The passbook T is conveyed by this rotation, and when the passbook reaches the dot print position as shown in FIG. 5, the dot head 9*a* is operated and printing is performed. When the printing is completed, the second drive motor 26 reversely rotates the entrance and exit roller pair 12, the feed roller pair 15, and the conveyance roller pairs 11*a* to 11*e* in the second direction. By this reverse rotation, the passbook T is reversely sent and is sent out from the facia section 2.

Next, a case where the statement sheet is printed will be described.

Figure 6:
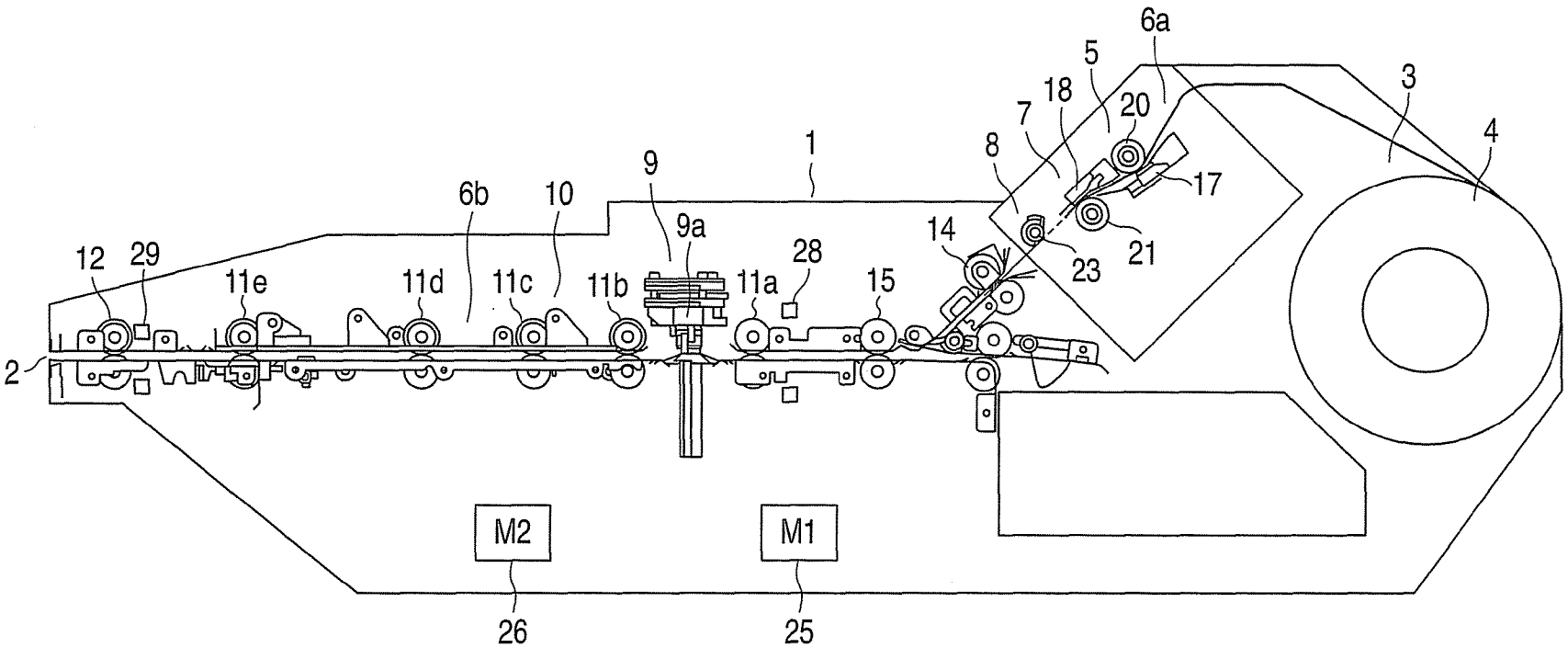
FIG. 6 is a view showing a state where a leading edge of a thermal sheet of FIG. 1 is set in a thermal print section.
Figure 7:
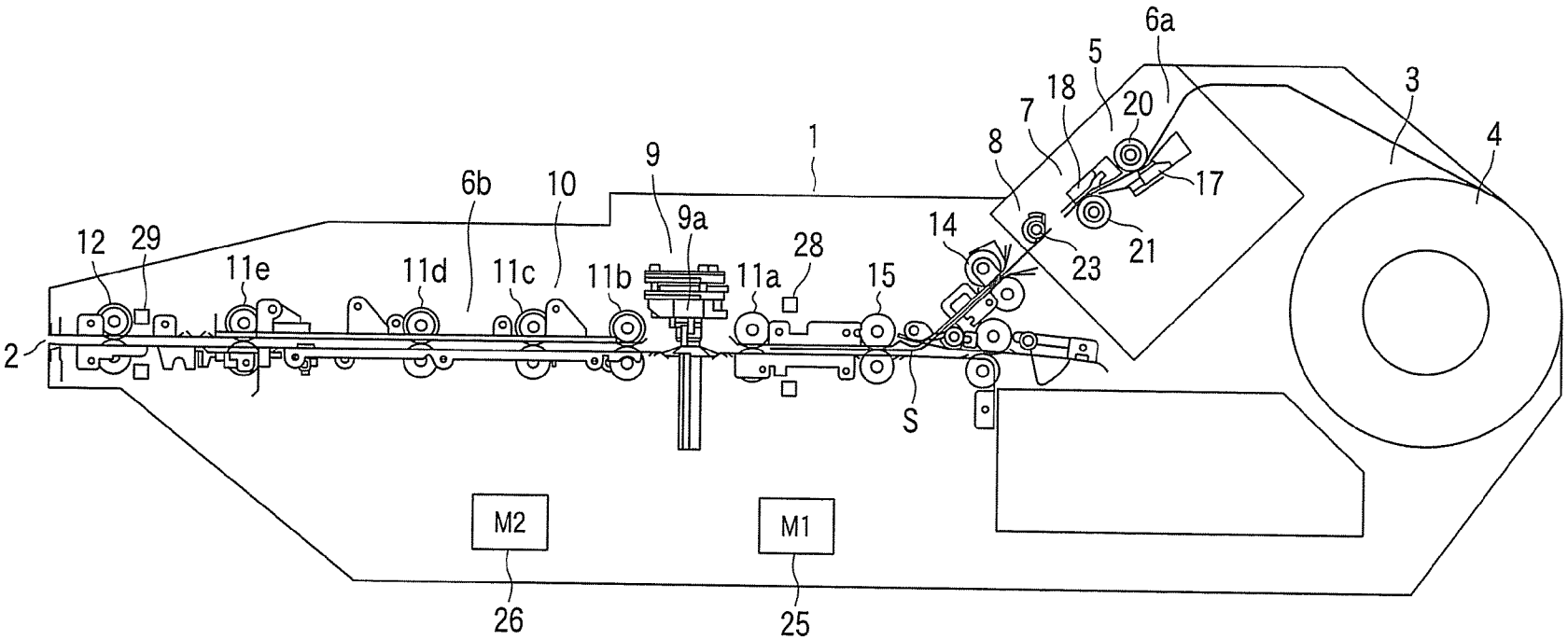
FIG. 7 is a view showing a state where after the thermal sheet of FIG. 6 is printed, it is cut into a statement sheet.
Figure 8:
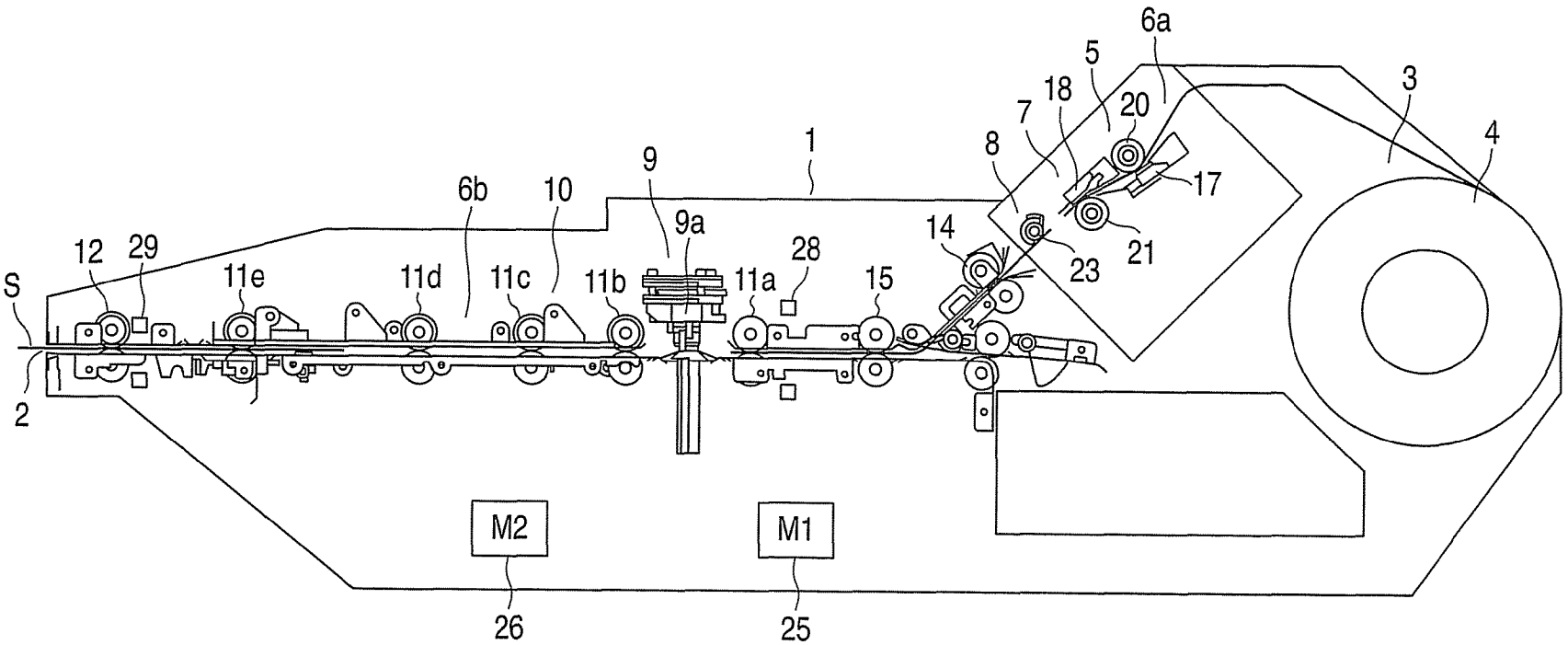
FIG. 8 is a view showing a state where the statement sheet of FIG. 7 is discharged.

As shown in FIG. 6, the leading edge side of the thermal sheet 4 is nipped between the first and the second platen rollers 20 and 21 and the first and the second thermal heads 17 and 18, and when the statement issue button 27 is turned on, the first drive motor 25 is operated to rotate the platen rollers 20 and 21. The thermal sheet 4 is conveyed by this rotation, and information is printed on the front and back surfaces of the thermal sheet 4 by the heat generation of the first and the second thermal heads 17 and 18. The thermal sheet 4 passes through the cutting section 8, and is nipped and conveyed by the thermal side feed roller pair 14. Then, when the leading edge of the thermal sheet 4 is detected by the thermal sheet detection sensor 28 as shown in FIG. 7, the rotary cutter 23 is rotated. By this rotation, the thermal sheet 4 is cut into a specified size, and the statement sheet S is formed. As shown in FIG. 8, the statement sheet S is conveyed along the conveyance path 6*b* by the reverse rotation of the feed roller pair 15, the conveyance roller pairs 11*a* to 11*e*, and the entrance and exit roller pair 12 and is discharged from the facia section 2.

As described above, according to the first embodiment, the dot head 9*a* is provided in the conveyance path 6*b* of the passbook T, the thermal heads 17 and 18 are disposed in the conveyance path 6*a* of the thermal sheet 4, and the print width size of each of the thermal heads 17 and 18 is made not smaller than the printing area of the dot head 9*a*. Accordingly, the thermal heads 17 and 18 can print also on the thermal sheet 4 wider than the printing area of the dot head 9*a*.

Accordingly, it becomes possible to issue the wide statement sheet S without increasing the width size of the apparatus body 1 and enlargement in size.

Second Embodiment

Figure 9:
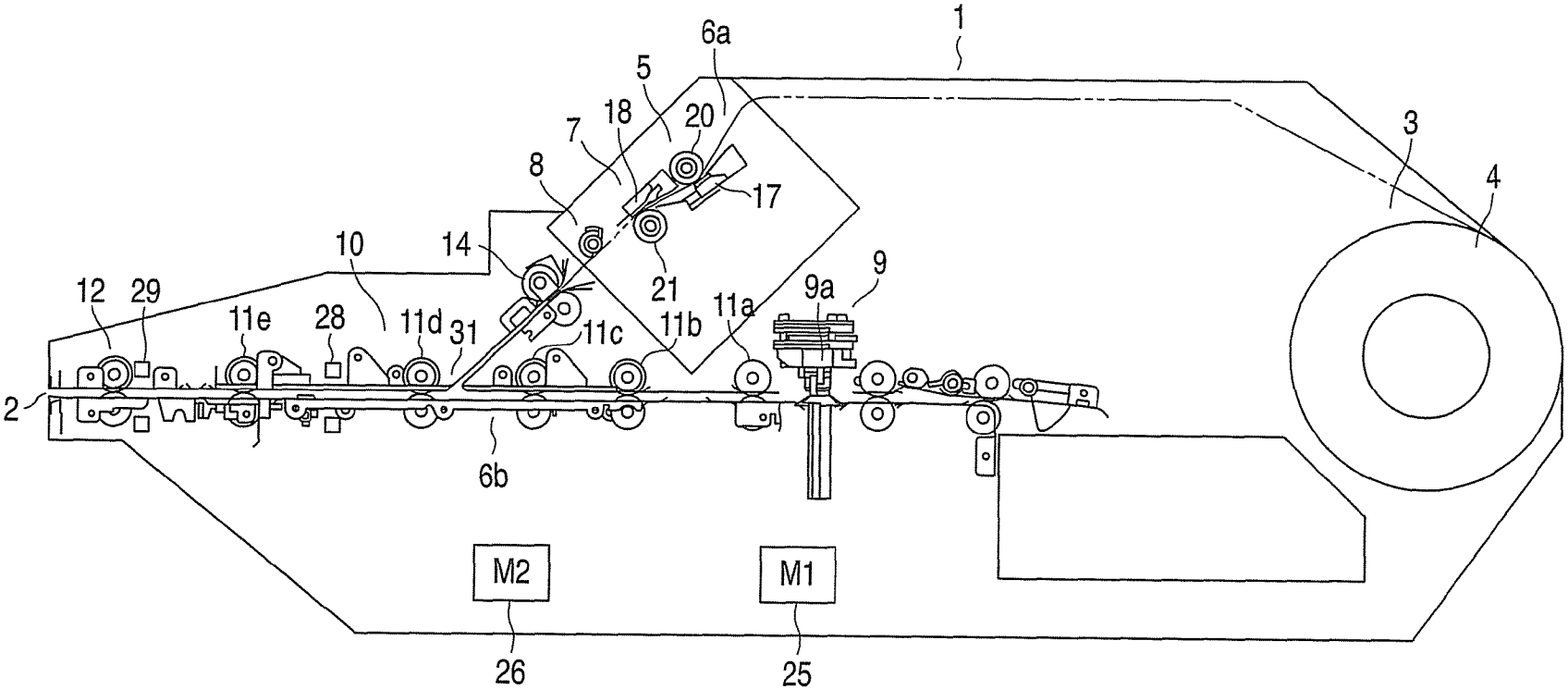
FIG. 9 is a structural view schematically showing a printing apparatus of a second embodiment of the invention.

FIG. 9 is a structural view showing a printing apparatus of a second embodiment of the invention.

Incidentally, the same portion as the portion described in the first embodiment is denoted by the same reference numeral.

In the drawing, reference numeral 1 denotes an apparatus body, and a facia section 2 used as both an entrance and exit port of a passbook and an exit port of a statement sheet are provided on the front side of the apparatus body 1.

A sheet loading section 3 is provided on the rear side in the apparatus body 1, and a roll-like thermal sheet (roll sheet) 4 is loaded in the sheet loading section 3. The leading edge of the thermal sheet 4 is pulled out from the sheet loading section 3, and is conveyed along a conveyance path (first conveyance path) 6*a* by a thermal conveyance device 5 as a first conveyance device. A thermal print section 7 and a cutting section 8 as a cutting device are sequentially disposed in the conveyance path 6*a* along a conveyance direction of the thermal sheet 4. Besides, a passbook conveyance device 10 as a second conveyance device to convey a passbook along a conveyance path (second conveyance path) 6*b* is provided in the apparatus body 1.

The passbook conveyance device 10 includes plural conveyance roller pairs 11*a* to 11*e* disposed at specified intervals in the conveyance path 6*b* and an entrance and exit roller pair 12. One end side of the conveyance path 6*b* is connected to the facia section 2, and a dot print section 9 including a dot head 9*a* as a serial head is disposed at the other end side.

Besides, a passbook insertion detection sensor 29 to detect the insertion of the passbook is provided at the one end side of the conveyance path 6*b*, and a detection sensor 28 to detect the leading edge of the introduced thermal sheet 4 is provided at a halfway part as described later.

Figure 10:
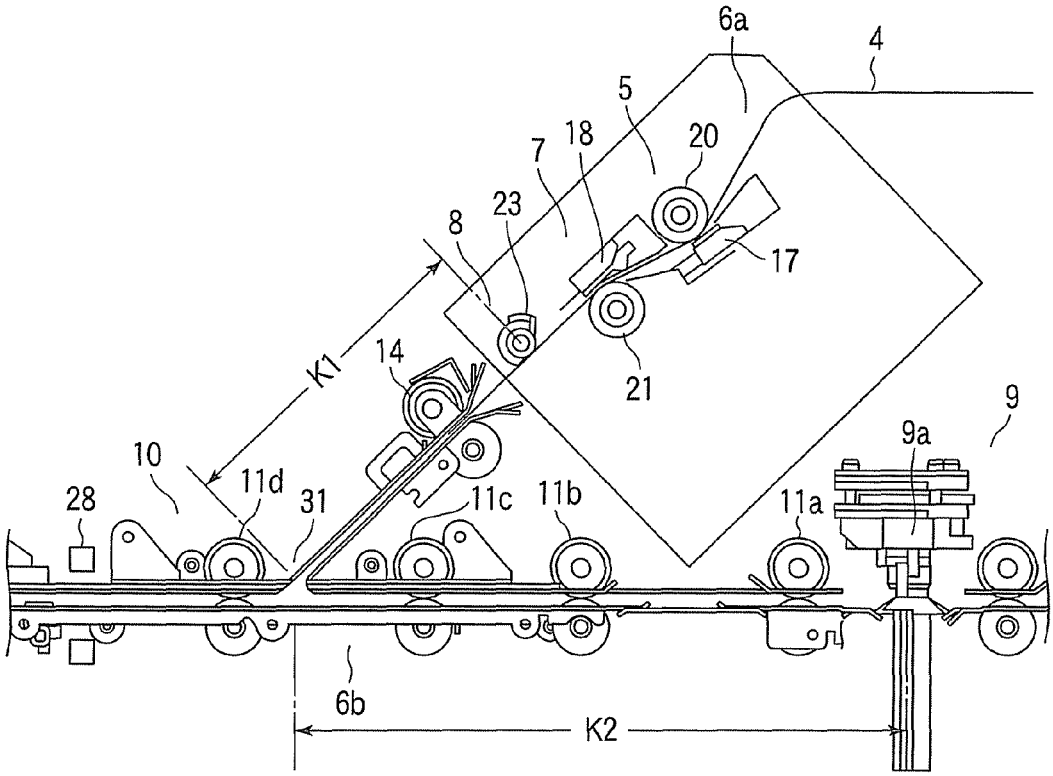
FIG. 10 is an enlarged view of a thermal print section and a dot print section of FIG. 9.

As shown in FIG. 10 of an enlarged view, the thermal print section 7 includes first and second thermal heads 17 and 18 as line heads disposed at specified intervals along the conveyance direction of the thermal sheet 4. First and second platen rollers 20 and 21 constituting the thermal conveyance device 5 rotatably contact with the first and the second thermal heads 17 and 18. The thermal sheet 4 is nipped and conveyed by the first and the second thermal heads 17 and 18 and the first and the second platen rollers 20 and 21, and information is printed on the front and back thereof by the first and the second thermal heads 17 and 18.

The cutting section 8 includes a rotary cutter 23, and the thermal sheet 4 is cut by the rotation of the rotary cutter 23, and a statement sheet is formed.

The first and the second platen rollers 20 and 21 constituting the thermal conveyance device 5, the rotary cutter 23 and a thermal side feed roller pair 14 are rotated in a direction of sending out the thermal sheet 4 by a first drive motor 25. Besides, the conveyance roller pairs 11*a* to 11*e* constituting the passbook conveyance device 10 and the entrance and exit roller pair 12 are rotated in positive and reverse directions by a second drive motor 26.

A discharge side of the conveyance path 6*a* of the thermal sheet 4 is connected and joined to a halfway part of the conveyance path 6*b* of the passbook. A joined part 31 of the conveyance path 6*a* and the conveyance path 6*b* is closer to the facia section 2 than the dot head 9*a*, and a distance K1 between the cut section 8 and the joined part 31 is shorter than a distance K2 between the dot head 9*a* and the joined part 31.

Accordingly, even when the statement sheet and the passbook are simultaneously printed by the thermal heads 17 and 18 and the dot head 9*a*, the statement sheet can be made to pass through the joined part 31 earlier than the passbook and can be discharged from the facia section 2.

Figure 11:
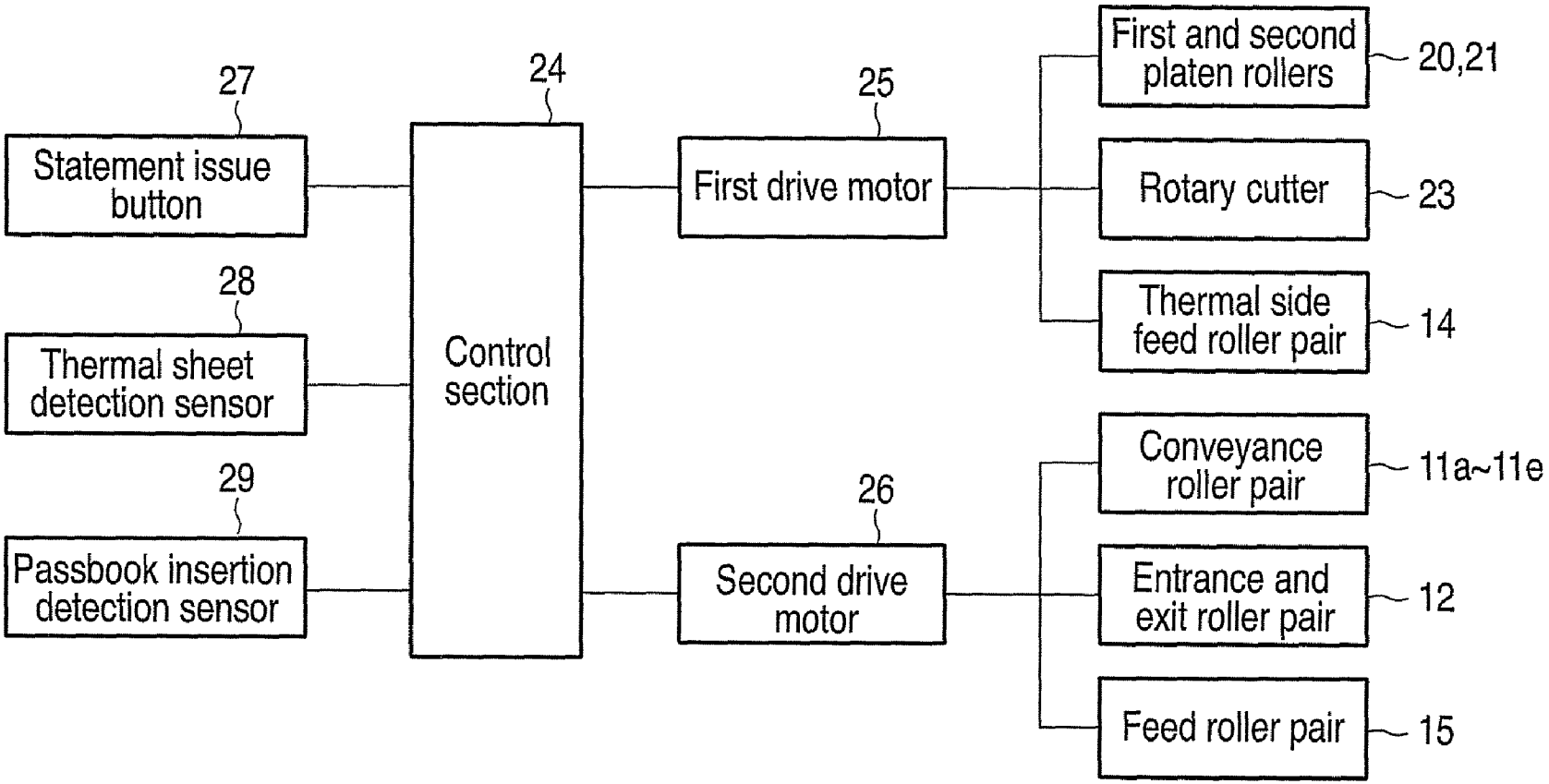
FIG. 11 is a block diagram showing a drive control system of the printing apparatus of FIG. 9.

FIG. 11 is a block diagram showing a drive control system of the printing apparatus.

The thermal sheet detection sensor 28, the passbook insertion detection sensor 29 and a statement sheet issue button 27 are connected to a control section 24 as a control device through a transmission circuit. The first and the second drive motors 25 and 26 are connected to the control section 24 through a control circuit. Incidentally, the control section 24 performs the same control operation as the first embodiment, and its detailed description is omitted.

Next, the print operation of the printing apparatus constructed as described above will be described.

First, a case where printing is performed on the passbook T will be described.

Figure 12:
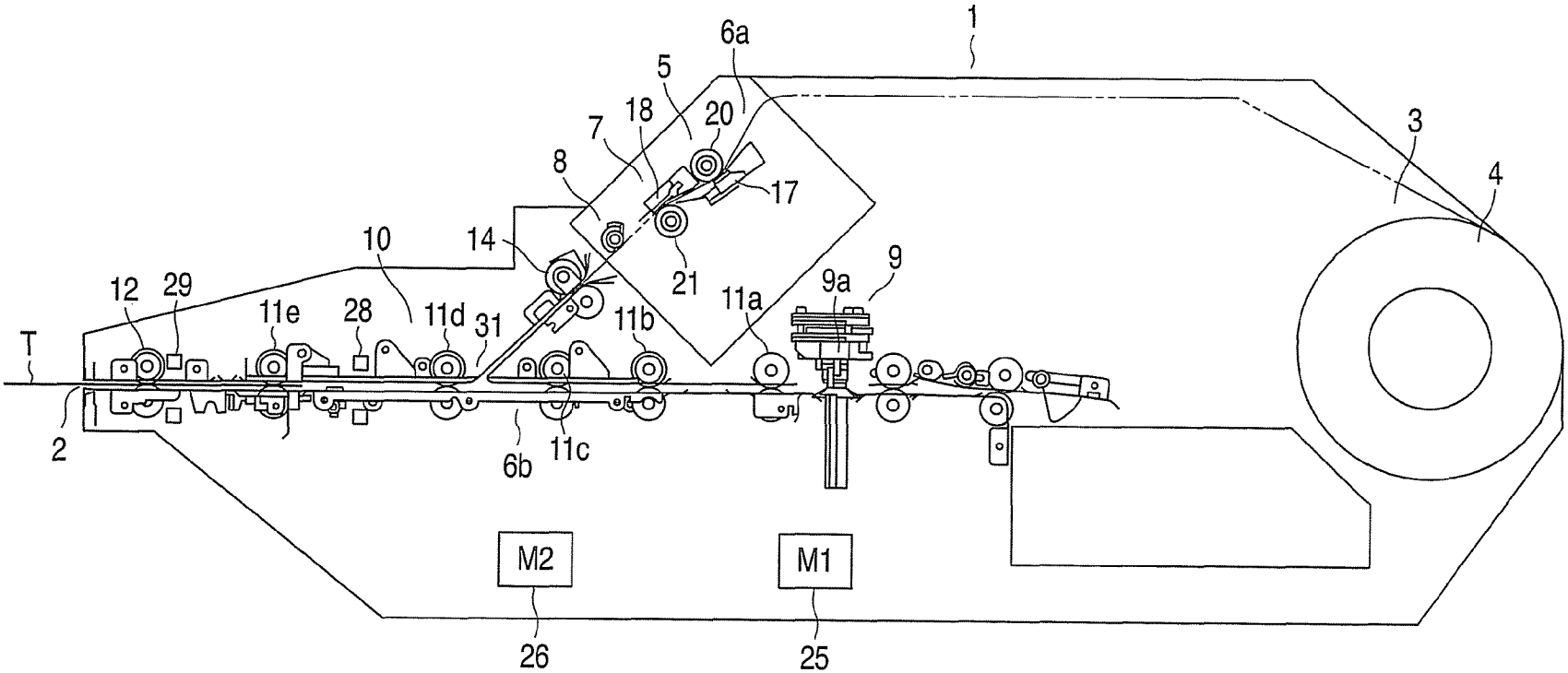
FIG. 12 is a view showing a state where a passbook is inserted in the printing apparatus of FIG. 9.
Figure 13:
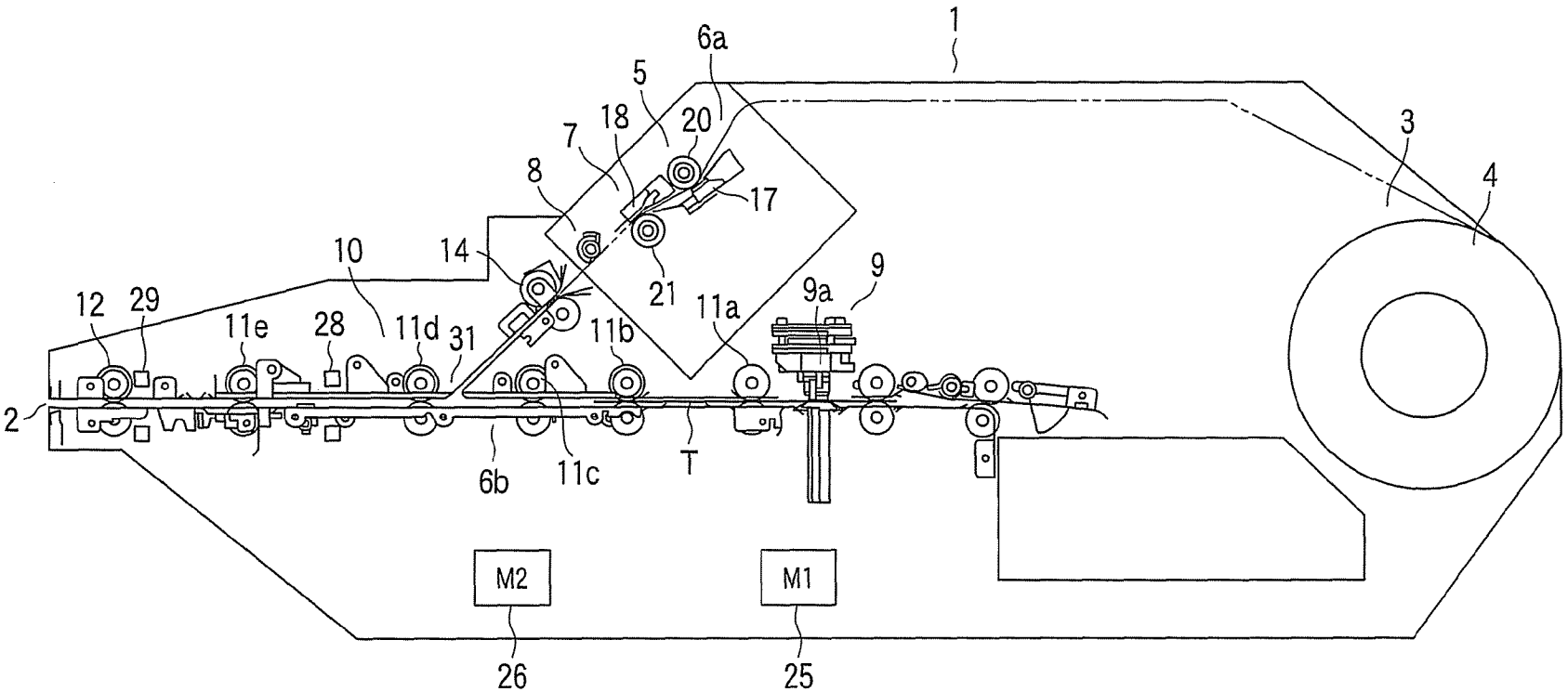
FIG. 13 is a view showing a state where the passbook of FIG. 12 is conveyed to a dot print section and is printed.

As shown in FIG. 12, when the passbook T is inserted from the facia section 2 and is detected by the passbook insertion detection sensor 29, the second drive motor 26 is operated to rotate the entrance and exit roller pair 12, and the conveyance roller pairs 11*a* to 11*e* in the positive direction. The passbook T is conveyed by this rotation, and when the passbook reaches the dot print position as shown in FIG. 13, the dot head 9*a* is operated and printing is performed. When the printing is completed, the entrance and exit roller pair 12 and the conveyance roller pairs 11*a* to 11*e* are rotated in the reverse direction by the second drive motor 26. By this reverse rotation, the passbook T is reversely sent and is sent out from the facia section 2.

Next, a case where a statement sheet is printed and is issued will be described.

Figure 14:
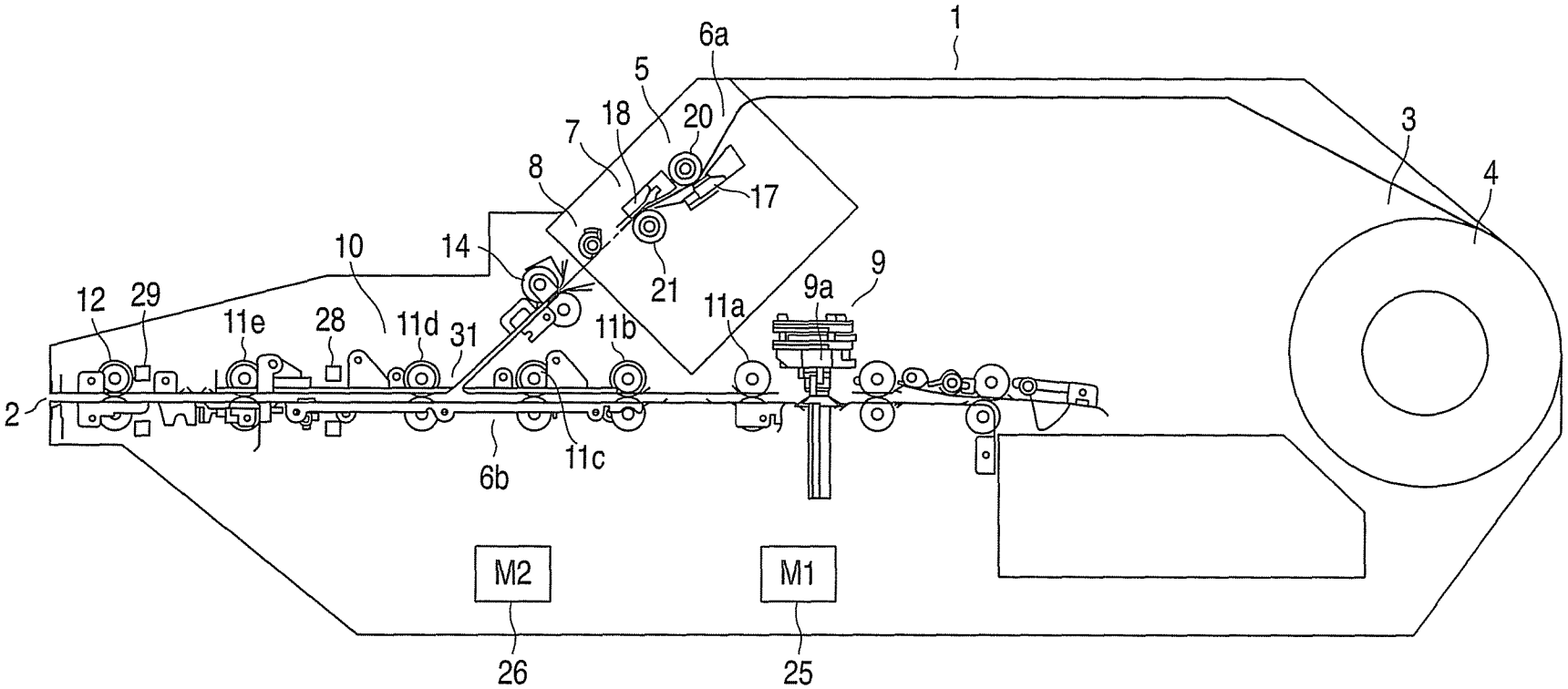
FIG. 14 is a view showing a state where a leading edge of a thermal sheet of FIG. 9 is set in a thermal print section.
Figure 15:
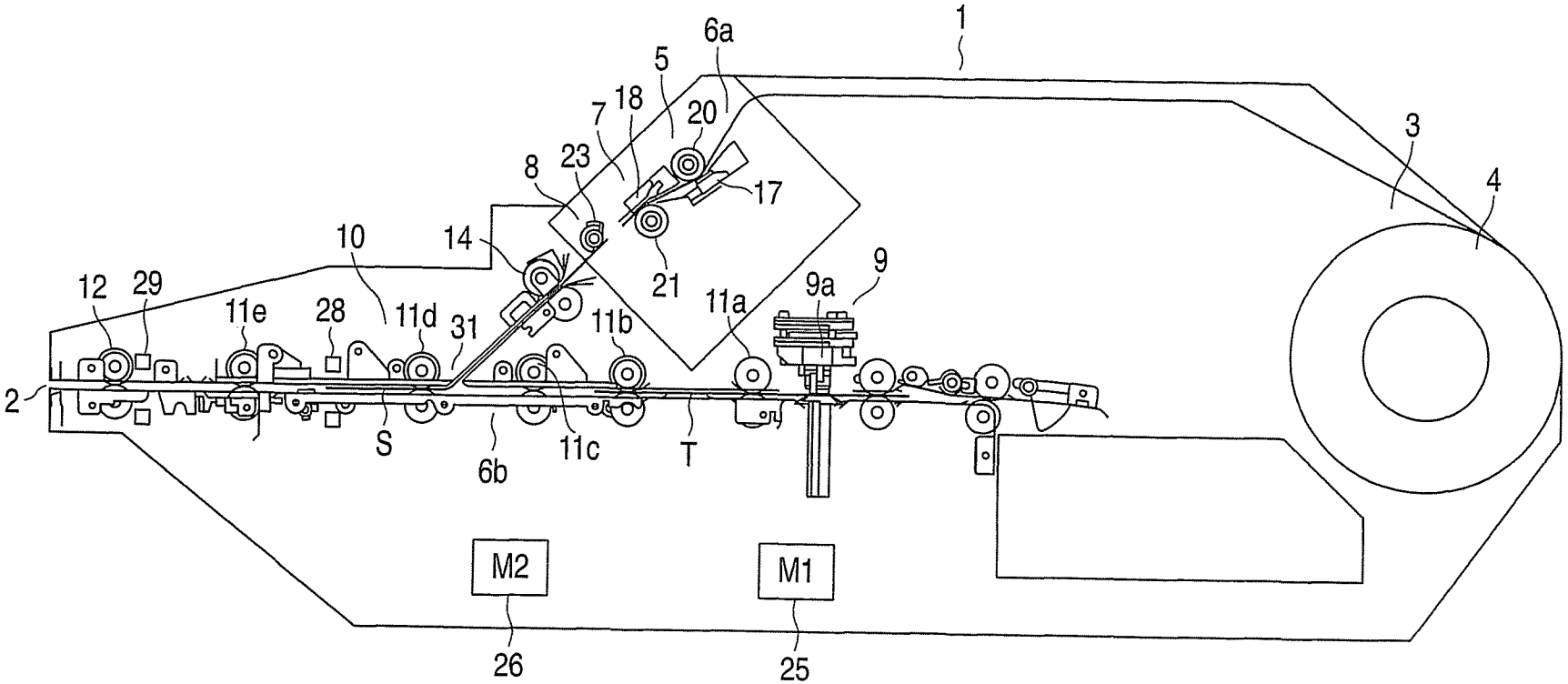
FIG. 15 is a view showing a state where after the thermal sheet of FIG. 14 is printed, it is cut into a statement sheet.
Figure 16:
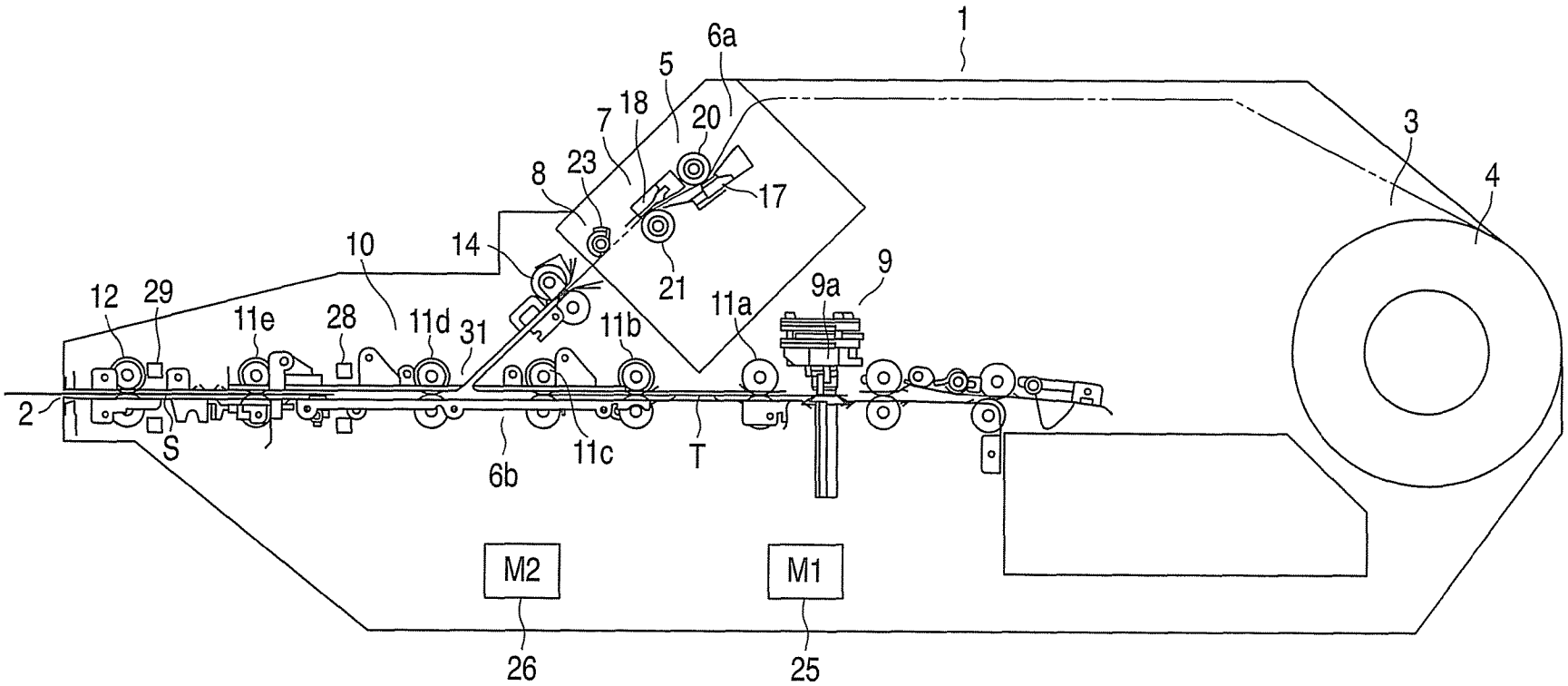
FIG. 16 is a view showing a state where the statement sheet of FIG. 15 is discharged.

The leading edge side of the thermal sheet 4 is in a state where it is nipped between the first and the second platen rollers 20 and 21 and the first and the second thermal heads 17 and 18 as shown in FIG. 14. When the statement issue button 27 is turned on, the first drive motor 25 is operated and the platen rollers 20 and 21 are rotated. The thermal sheet 4 is conveyed by this rotation, and information is printed on the front and back surfaces of the thermal sheet 4 by heat generation of the first and the second platen rollers 20 and 21. After this printing, the thermal sheet 4 passes through the cutting section 8, and is nipped and conveyed by the feed roller pair 14. When the leading edge thereof is detected by the thermal sheet detection sensor 28 as shown in FIG. 15, the rotary cutter 23 is rotated to cut the thermal sheet 4 into a specified size, and a statement sheet S is formed. As shown in FIG. 16, the statement sheet S is conveyed along the conveyance path 6*b* by the reverse rotation of the conveyance roller pairs 11*d* and 11*e* and the entrance and exit roller pair 12, and is discharged from the facia section 2.

In this printing apparatus, there is a case where the passbook T and the statement sheet S are simultaneously printed.

In the second embodiment, as shown in FIG. 10, the joined part 31 of the conveyance path 6*a* of the thermal sheet 4 and the conveyance path 6*b* of the passbook T is closer to the facia section 2 than the dot head 9*a*, and the distance K1 between the cutting section 8 and the joined part 31 is shorter than the distance K2 between the dot head 9*a* and the joined part 31.

By this, before the passbook T printed by the dot head 9*a* reaches the joined part 31, the statement sheet S printed by the thermal heads 17 and 18 can be made to pass through the joined part 31, and can be discharged from the facia section 2.

Accordingly, unlike the related art, the statement sheet S can be discharged without waiting for the completion of printing of the passbook T by the dot head 9*a*, and there is a merit that the waiting time required for the user to receive the statement sheet S can be shortened.

Third Embodiment

In the second embodiment, the joined part 31 of the conveyance path 6*a* of the thermal sheet 4 and the conveyance path 6*b* of the passbook T is closer to the facia section 2 than the dot head 9*a*, and the distance K1 between the cutting section 8 and the joined part 31 is shorter than the distance K2 between the dot head 9*a* and the joined part 31. However, no limitation is made to this, and modifications may be made as described below.

That is, a conveyance speed of the thermal conveyance device 5 as the first conveyance device is made a first conveyance speed, a conveyance speed of the passbook conveyance device 10 as the second conveyance device is made a second conveyance speed different from the first conveyance speed, and the first conveyance speed is made higher than the second conveyance speed.

According to this, even when the distance K2 between the dot head 9*a* and the joined part 31 is shortened to be equal to the distance K1 between the cutting section 8 and the joined part 31, the statement sheet S and the passbook T can be discharged without collision with each other at the joined part 31.

Accordingly, the dot head 9*a* can be made to approach the joined part 31 by the shortening of the distance K2, and the miniaturization becomes possible.

Besides, when the first conveyance speed is made much higher than the second conveyance speed, even when the distance K1 between the cutting section 8 and the joined part 31 is made longer than the distance K2 between the dot head 9*a* and the joined part 31, the statement sheet S and the passbook T can be discharged without collision with each other at the joined part 31.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A printing apparatus comprising:

a conveyance device to convey a print medium along a conveyance path;

a serial head that is provided in the conveyance path and moves along a head movement path which is orthogonal to a conveyance direction of the print medium and in which one end side is a speed-up area, a halfway part is a constant speed printing area, and the other end side is a slow-down area; and a line head that is disposed in the conveyance path along a direction orthogonal to the conveyance direction of the print medium, and has a print width size in the orthogonal direction not smaller than the printing area of the serial head.

2. The apparatus of claim 1, wherein the serial head is a dot head, and the line head is a thermal head.

3. The apparatus of claim 1, wherein the print medium is a passbook and a statement sheet.

4. The apparatus of claim 3, wherein the passbook is printed by the serial head, and the statement sheet is printed by the line head.

5. A printing apparatus comprising:

a discharge port to discharge a passbook or a statement sheet;

a first conveyance device to convey a roll sheet along a first conveyance path;

a line head to print on the roll sheet conveyed by the first conveyance device;

a cutting device to cut the roll sheet printed by the line head into a specified size and to form a statement sheet;

a second conveyance device to convey the passbook along a second conveyance path connected to the discharge port; and a serial head to print on the passbook conveyed by the second conveyance device, wherein a discharge side of the first conveyance path is joined to a halfway part of the second conveyance path, a joined part is closer to the discharge port than the serial head, and a distance between the cutting device and the joined part is shorter than a distance between the serial head and the joined part.

6. The apparatus of claim 5, wherein the serial head is a dot head, and the line head is a thermal head.

7. The apparatus of claim 5, wherein the print medium is a passbook and a statement sheet.

8. The apparatus of claim 7, wherein the passbook is printed by the serial head, and the statement sheet is printed by the line head.

9. A printing apparatus comprising:

a discharge port to discharge a passbook or a statement sheet;

a first conveyance device to convey a roll sheet along a first conveyance path at a first conveyance speed;

a line head to print on the roll sheet conveyed by the first conveyance device;

a cutting device to cut the roller sheet printed by the line head into a specified size and to form a statement sheet;

a second conveyance device to convey the passbook along a second conveyance path connected to the discharge port at a second conveyance speed different from the first conveyance speed; and a serial head to print on the passbook conveyed by the second conveyance device, wherein the first conveyance speed is higher than the second conveyance speed.

10. The apparatus of claim 9, wherein the serial head is a dot head, and the line head is a thermal head.

* * * * *